United States Patent [19]

Binet et al.

[11] 4,308,081

[45] Dec. 29, 1981

[54] WATER-IN-OIL EMULSION BLASTING AGENT

[75] Inventors: Rejean Binet, St. Bruno; Philip F. L. Seto, Scarborough, both of Canada

[73] Assignee: Canadian Industries Limited, Montreal, Canada

[21] Appl. No.: 97,326

[22] Filed: Nov. 26, 1979

[30] Foreign Application Priority Data

Dec. 8, 1978 [CA] Canada ..... 317649

[51] Int. Cl.[3] ..... .. C06B 45/00

[52] U.S. Cl. ..... 149/2; 149/60; 149/61

[58] Field of Search ..... 149/2, 2 F, 60, 61

[56] References Cited

U.S. PATENT DOCUMENTS

| | | | |
|---|---|---|---|
| 3,765,964 | 10/1973 | Wade | 149/2 |
| 4,110,134 | 8/1978 | Wade | 149/2 |
| 4,141,767 | 2/1979 | Sudweeks | 149/2 |
| 4,248,644 | 2/1981 | Healy | 149/2 |

*Primary Examiner*—Edward A. Miller

*Attorney, Agent, or Firm*—Donald G. Ballantyne

[57] ABSTRACT

A water-in-oil emulsion explosive composition is provided containing sorbitan mono-oleate, sorbitan sesquioleate and glycerides of fatty acids as the emulsification agent and also containing a highly clorinated paraffinic hydrocarbon as an emulsification promoter. The presence of the clorinated hydrocarbon produces improved sensitivity even in small diameter cartridges.

8 Claims, No Drawings

WATER-IN-OIL EMULSION BLASTING AGENT

This invention relates to an emulsion blasting agent of the type having an aqueous salt solution discontinuous phase, a liquefiable carbonaceous fuel continuous phase and containing occluded gas bubbles or gas-containing material as a further discontinuous phase. In particular, the invention describes a gas-containing emulsion explosive composition of enhanced sensitivity which, though devoid of any self-explosive ingredient, may be detonated in very small diameter charges.

Emulsion type explosive compositions are now well known in the explosives art. Bluhm, in U.S. Pat. No. 3,447,978, discloses a composition comprising an aqueous discontinuous phase containing dissolved oxygen-supplying salts, a carbonaceous fuel continuous phase, an occluded gas and a water-in-oil emulsifying agent. Optional particulate carbonaceous or metal fuel can be included. The compositions of Bluhm are somewhat limited in utility since detonation is possible only with relatively large diameter charges and the compositions require initiation by means of a substantial primer. Cattermole et al., in U.S. Pat. No. 3,674,578, describe a water-in-oil emulsion explosive comprising an inorganic salt, a nitrogen-base salt such as an amine nitrate, water, a water-insoluble oil as fuel, an emulsifier for the oil and incorporated gas bubbles. The composition of Cattermole, while detonable in charges having diameters of as little as 2 inches, requires the use of a nitrogen-base salt, e.g. ethylenediamine dinitrate, which is per se a self-explosive material. Wade, in U.S. Pat. No. 3,715,247, describes a small-diameter cap-sensitive emulsion type explosive composition comprising carbonaceous fuel, water, inorganic salts, an emulsifier, gas bubbles and a detonation catalyst consisting of a water-soluble salt containing selected metals. Wade again, in U.S. Pat. No. 3,765,964 describes an improvement in the composition of U.S. Pat. No. 3,715,247 by including therein a water-soluble strontium compound to provide further sensitivity.

While all of the aforementioned compositions are meritorious they are not without some disadvantages. The composition of Bluhm, for example, is only suitable for use in large diameter charges and requires strong primer initiation. The compositions of Cattermole et al. and Wade, while useful in small diameter charges, require the use of expensive raw materials, demand extra handling precautions because of the sensitive nature of the ingredients used and hence lead to increase costs.

It has now been found that all of the aforementioned disadvantages can be overcome. The present invention provides an improved small-diameter, water-in-oil emulsion explosive composition which, even when devoid of any sensitive explosive ingredient, is sensitive to detonation by means of an ordinary blasting cap at densities greater than 1.10 g/cm$^3$. The improved composition of the invention comprises an aqueous solution of inorganic oxygen-supplying salt as the discontinuous phase, an insoluble, liquefiable carbonaceous fuel as the continuous phase, occluded gas bubbles, a water-in-oil type emulsifying agent selected from the group of sorbitan mono-oleate, sorbitan sesquioleate, mono and diglycerides of fat-forming fatty acids an mixtures of these and, as an emulsification promotion agent, a small amount of a highly chlorinated paraffinic hydrocarbon. By highly chlorinated paraffinic hydrocarbon is meant a product obtained by the chlorination of long chain (typically $C_{10}$–$C_{20}$) paraffinic hydrocarbons and containing at least 50% by weight of chlorine. Such material is available from Imperial Chemical Industries Limited of London, England and is sold under the registered trade mark "CERECLOR".

The following examples and tables demonstrate the utility of the present invention.

EXAMPLE 1

Two water-in-oil emulsion explosive compositions were prepared from water, inorganic oxygen-supplying salts, liquefiable carbonaceous fuels and emulsifiers. To one of the two compositions was added, as an emulsification promoter, a small amount of a highly chlorinated paraffinic hydrocarbon containing 70% by weight of chlorine. The method of preparation comprised heating together the liquefiable carbonaceous fuel (wax), the hydrocarbon oil, mixed emulsifiers and the emulsification promoter at a temperature of from 60° C. to 85° C. until the wax ingredient was liquefied. A separate aqueous solution of inorganic salts and sodium borate buffer was prepared at a temperature of from 60° C. to 85° C. and mixed into the fuel/emulsifier solution with a high shear mixing apparatus to form a water-in-oil emulsion. Air was then whipped into the emulsion during cooling where it became occluded at the congealing temperature of the fuel solution.

The ingredients of the composition as well as the density and sensitivity of the final mixtures are shown in Table I, below, the quantities shown being in percent by weight.

TABLE I

| Ingredients | Mix No. 1 | Mix No. 2 |
|---|---|---|
| Ammonium nitrate | 61.4 | 61.4 |
| Sodium nitrate | 17.0 | 17.0 |
| Sodium borate | 0.2 | 0.2 |
| Water | 15.4 | 15.0 |
| Emulsifiers | | |
| Sorbitan sesqui-oleate | 0.69 | 0.69 |
| Mono and diglycerides of fat forming fatty acids | 0.69 | 0.69 |
| Plant lecithin | 0.02 | 0.02 |
| CERECLOR (Reg. trade mark) 70L | 0.58 | — |
| Paraffin wax | 1.82 | 2.5 |
| TEXACO (Reg. trade mark) mineral oil No. 522 | 2.2 | 2.5 |
| Density as made (g/cc) | 1.10 | 1.10 |
| Oxygen balance | +2.2 | −0.3 |
| Cartridge diameter (inch) | 5/8 | 5/8 |
| Temperature °C. | −1 | 5 |
| Minimum initiator | High strength cap containing 0.8 g of PETN | 2.5 g explosive booster |

From the results in Table I it can be seen that Mix No. 1 containing CERECLOR could be initiated by means of a high strength cap even at very low temperatures, while Mix No. 2, devoid of CERECLOR, required the use of a 2.5 g explosive booster to achieve detonation.

EXAMPLE 2

A series of water-in-oil emulsion explosives were made in a manner similar to that described in Example 1 and varying amounts of chlorinated paraffinic hydrocarbon were added to separate mixes. The sensitivity of the separate mixes was determined. The results are shown in Table II below, the quantities shown being in percent by weight.

TABLE II

| Ingredients | Mix No. 3 | Mix No. 4 | Mix No. 5 | Mix No. 6 |
|---|---|---|---|---|
| Ammonium nitrate | 61.7 | 61.6 | 61.5 | 61.3 |
| Sodium nitrate | 16.6 | 16.6 | 16.5 | 16.5 |
| Sodium borate | 0.5 | 0.5 | 0.5 | 0.5 |
| Water | 12.6 | 12.6 | 12.6 | 12.5 |
| Emulsifier (sorbitan mono-oleate) GLYCOMUL O (trademark) | 1.4 | 1.4* | 1.4 | 1.4 |
| CERECLOR 70L | — | 0.2 | 0.5 | 1.0 |
| Paraffin wax | 2.0 | 2.0 | 2.0 | 2.0 |
| Paraffin oil | 2.9 | 2.8 | 2.7 | 2.5 |
| Glass microspheres | 2.3 | 2.3 | 2.3 | 2.3 |
| Density (g/cc) | 1.17 | 1.16 | 1.12 | 1.15 |
| Oxygen balance | 0 | +0.1 | −0.1 | −0.1 |
| Cartridge diameter (inch) | 1 | 1 | 1 | 1 |
| Temperature °C. of detonation test cartridges | 7 | 7 | 7 | 5 |
| Minimum initiator | 2.5 g high explosive booster | No. 10 fulminate/chlorate cap | No. 6 fulminate/chlorate cap | Electric blasting cap |

*Including 0.2% by weight of plant lecithin

An examination of the results in Table II demonstrate that Mix No. 3 containing no CERECLOR required substantial boosting to produce initiation while Mixes No. 4, No. 5 and No. 6 were detonable by means of standard caps. Mix No. 6 further demonstrates that no particular advantage is gained in sensitivity by employing CERECLOR in an amount as great as 1.0% by weight. Indeed, a slight drop off in sensitivity is observed at this level. However, amounts of CERECLOR up to 2.0% by weight of the total composition have been found to be effective.

EXAMPLE 3

A series of three water-in-oil emulsion explosives were prepared in a manner similar to that described in Example 1. Chlorinated paraffinic hydrocarbons containing varying amounts of chlorine were added to the separate mixes and sensitivity of the mixes was determined. The results are shown in Table III below, where the quantities shown are by percent by weight.

TABLE III

| Ingredients | Mix No. 7 | Mix No. 8 | Mix No. 9 |
|---|---|---|---|
| Ammonium nitrate | 61.5 | 61.5 | 61.5 |
| Sodium nitrate | 16.5 | 16.5 | 16.5 |
| Sodium borate | 0.5 | 0.5 | 0.5 |
| Water | 12.6 | 12.6 | 12.6 |
| Emulsifier (sorbitan mono-oleate) GLYCOMUL 0 (trade mark) | 1.4 | 1.4 | 1.4 |
| CERECLOR 54* | 0.5 | | |
| CERECLOR 65L** | | 0.5 | |
| CERECLOR 70L*** | | | 0.5 |
| Paraffin wax | 2.0 | 2.0 | 2.0 |
| Paraffin oil | 2.7 | 2.7 | 2.7 |
| Glass microspheres | 2.3 | 2.3 | 2.3 |
| Density (g/cc) | 1.15 | 1.12 | 1.12 |
| Oxygen balance | −0.3 | −0.2 | 0.1 |
| Cartridge diameter (inch) | 1 | 1 | 1 |
| Temperature °C. | 7 | 7 | 7 |
| Minimum initiator | Electric blasting cap | No. 9 fulminate/chlorate cap | No. 6 fulminate/chlorate cap |

*contains 54%/w chlorine
**contains 65%/w chlorine
***contains 70%/w chlorine

From the results shown in Table III it can be observed that the use of a chlorinated hydrocarbon having a high chlorine content (Mix No. 9) results in a somewhat more sensitive composition than that obtained using a chlorinated hydrocarbon of lesser chlorine content.

The preferred inorganic oxygen-supplying salt suitable for use in the improved explosive composition of the invention is ammonium nitrate; however a portion of the ammonium nitrate may be replaced by other inorganic oxygen-supplying salts such as sodium nitrate and calcium nitrate.

Suitable water-immiscible emulsifiable fuels for use in the composition include petroleum oils such as No. 2 fuel oil, paraffin oil, mineral oils and vegetable oils. Liquefiable waxes such as paraffin waxes, microcrystalline waxes and mineral waxes are also suitable fuels. Particularly preferred is a mixture of paraffin wax and paraffin oil of medium viscosity in order to provide good stability and sensitivity.

The emulsifiers which are suitable for use in the composition are emulsifiers derived from sorbitol by esterification, for example, sorbitan mono-oleate and sorbitan sesqui-oleate, as well as the mono and diglycerides of fat-forming fatty acids. Mixtures of all of these may be employed. It has been noted that these emulsifiers may show small differences in performances depending on their source and the quantities of impurities which may be present therein. It has been surprisingly found that a portion of the oil-soluble water-in-oil emulsifier may be replaced in the present composition with a plant lecithin, suitably technical grade soybean lecithin. While plant lecithin is not suitable for use by itself in the present composition, its combination with a typical water-in-oil emulsifier such as sorbitan sesqui-oleate, in proportions up to 50%, provides the same emulsifying action as does the use of sorbitan sesqui-oleate alone. Thus a substantial proportion of the more costly water-in-oil emulsifier can be replaced by relatively low cost plant lecithin without sacrifice in product quality.

EXAMPLE 4

To demonstrate the utility of a plant lecithin-substituted emulsifier in the composition of the invention, three explosive mixtures were prepared in the same manner as described in Example 1. To each of the mixes varying amounts of a blended lecithin/water-in-oil emulsifier were added and the resulting compositions tested for sensitivity. The results are recorded in Table IV below, the amounts shown being expressed as percent by weight.

TABLE IV

| Ingredients | Mix No. 10 | Mix No. 11 | Mix No. 12 |
|---|---|---|---|
| Ammonium nitrate | 61.6 | 61.5 | 60.3 |
| Sodium nitrate | 16.5 | 16.5 | 16.6 |
| Sodium borate | 0.5 | 0.5 | 0.5 |
| Water | 12.6 | 12.6 | 14.6 |
| Emulsifier (sorbitan sesqui-oleate) | 1.2 | 1.0 | 0.6 |
| Plant lecithin | 0.2 | 0.4 | 0.6 |
| CERECLOR 70L | 0.6 | 0.6 | 0.5 |

TABLE IV-continued

| Ingredients | Mix No. 10 | Mix No. 11 | Mix No. 12 |
|---|---|---|---|
| Paraffin wax | 2.0 | 2.0 | 1.5 |
| Paraffin oil | 2.5 | 2.6 | 2.5 |
| Glass microspheres | 2.3 | 2.3 | 2.3 |
| Density (g/cc) | 1.16 | 1.17 | 1.12 |
| Oxygen balance | +0.4 | +0.1 | +2.6 |
| Cartridge diameter (inch) | 1 | 1 | 1 |
| Temperature °C. | 6 | 6 | 4 |
| Minimum initiator | No. 9 fulminate/ chlorate cap | No.9 fulminate/ chlorate cap | Electric blasting cap |

As can be seen from Table IV, the use of a blended emulsifier containing up to 50% by weight of plant lecithin provides efficient emulsification without sacrifice in composition sensitivity or quality.

The emulsion explosive composition of the invention may be made using conventional high shear mixing apparatus normally used in emulsification processes.

In preparation, the carbonaceous fuel, emulsifier and emulsification promoter are first added to the mixer bowl and heated to a temperature of from 60° C. to 85° C. until liquefication is achieved. A solution of oxidizer salt, water and any buffering agent is separately prepared and added to the liquefied fuel in the mixer at a temperature of from 60° C. to 85° C. Mixing is continued until a viscous water-in-oil emulsion is formed. Where the inorganic salt used contains additives such as anti-caking materials and the like, the solution of oxidizer salt is preferably filtered before addition to the liquefied fuel in order to remove any insoluble matter which may be present. Such insoluble matter has been noted to adversely affect the emulsification and stability of the final composition. During cooling, air is whipped into the mixture by further agitations. Air-containing particulate material such as glass microspheres, if used, can also be added at any time after the emulsion is formed. The amount of air-containing particulate material employed will be sufficient to maintain the density of the composition between 1.00 and 1.25 grams/cc. After mixing, the product may be cartridged or carried to the blasting site and pumped directly in lined boreholes.

The quantity of oxygen-supplying salt used in the composition may range from 55% to 85% by weight. The amount of liquid or liquefiable carbonaceous fuel may be used in an amount of from 2% to 10% by weight. From 0.5% to 2% by weight of a water-in-oil emulsifier may be used and water in an amount of from 10% to 25% is suitable. The quantity of the highly chlorinated paraffinic hydrocarbon emulsification promoter suitable for use is from 0.1% to 2% by weight. A preferred composition comprises 75% to 83% by weight of oxidizing salts, 10% to 16% by weight of water, 3% to 6% by weight of liquefiable fuel, 0.7% to 1.6% by weight of emulsifier and 0.2% to 1% by weight of emulsification promoter.

The present invention thus provides a composition detonable in small diameter charges without the aid of any booster or primer. Because the composition is devoid of any self-explosive or other sensitive material, it may be manufactured safely and at low cost and stored and shipped with minimum risk. The composition lends itself to preparation in the explosive factory where it may be packaged for use or it may be prepared at the blasting site in a mobile mixing facility.

We claim:

1. A water-in-oil emulsion explosive composition which is cap-sensitive in small diameter charges, which comprises (a) an aqueous solution of inorganic oxygen-supplying salt as a discontinuous emulsion phase;

(b) a water-immiscible liquefiable carbonaceous fuel as a continuous emulsion phase;

(c) occluded gas dispersed in said emulsion as an additional discontinuous phase;

(d) an oil-soluble emulsification agent selected from the group consisting of sorbitan mono-oleate, sorbitan-sesqui-oleate, mono and diglycerides of fat-forming fatty acids or mixtures thereof;

(e) an emulsification promoter comprising from 0.1% to 2.0% by weight of the total composition of a highly chlorinated paraffinic hydrocarbon comprising 10 to 20 carbon atoms.

2. A composition as claimed in claim 1 wherein the inorganic oxygen-supplying salt is selected from the group consisting of the nitrates of ammonia, sodium and calcium and mixtures thereof.

3. A composition as claimed in claim 1 wherein the water-immiscible liquefiable carbonaceous fuel is selected from the group consisting of petroleum oil, paraffin oil, mineral oil, vegetable oil, paraffin wax, microcrystalline wax and mineral wax and mixtures thereof.

4. A composition as claimed in claim 1 wherein the said highly chlorinated paraffic hydrocarbon contains from 50% to 80% by weight of chlorine.

5. A composition as claimed in claim 1 wherein up to 50% by weight of the said oil-soluble emulsification agent is replaced by plant lecithin.

6. A composition as claimed in claim 1 also containing gas-containing particulate matter.

7. A cap-sensitive water-in-oil emulsion explosive composition comprising essentially from 10% to 25% by weight of water, from 55% to 85% by weight of an inorganic oxygen-supplying salt, from 2% to 10% by weight of a water-immiscible liquefiable carbonaceous fuel, from 0.5% to 2% by weight of a water-in-oil emulsification agent, occluded gas, and as an emulsification promoter 0.1% to 2% by weight of a highly chlorinated paraffinic hydrocarbon comprising 10 to 20 carbon atoms.

8. A composition as claimed in claim 7 also containing gas-containing particulate material sufficient to maintain the density of the composition between 1.00 and 1.25 grams/cc.

* * * * *